United States Patent [19]

Lang

[11] Patent Number: 5,023,977

[45] Date of Patent: Jun. 18, 1991

[54] SLIVER GUIDE FOR A TEXTILE MACHINE

[75] Inventor: Helfried Lang, Winterthur, Switzerland

[73] Assignee: Riter Machine Works, Ltd., Winterthur, Switzerland

[21] Appl. No.: 372,315

[22] Filed: Jun. 28, 1989

[30] Foreign Application Priority Data

Jul. 4, 1988 [CH] · Switzerland ..... 02536/88

[51] Int. Cl.[5] ..... D01G 19/00

[52] U.S. Cl. ..... 19/115 R; 19/288; 29/116.1

[58] Field of Search ..... 19/115 R, 159 R, 150, 19/115 A, 288, 244, 236; 112/302; 29/116.1

[56] References Cited

U.S. PATENT DOCUMENTS 3,349,462 10/1967 Mott ..... 29/116
4,038,723 8/1977 Felix ..... 19/215
4,419,791 12/1983 Schar ..... 19/215

FOREIGN PATENT DOCUMENTS 0572529 12/1975 Switzerland .
1192559 5/1970 United Kingdom .
1425001 2/1976 United Kingdom .

*Primary Examiner*—Werner H. Schroeder
*Assistant Examiner*—Michael A. Neas
*Attorney, Agent, or Firm*—Kenyon & Kenyon

[57] ABSTRACT

The sliver guide is comprised of a cylindrical sleeve rotatably mounted on an inner element fixed to the guide table. The sleeve carries a radial outwardly projecting flange above the table in order to support the combed sliver such that the moving sliver rotates the sleeve so that sliding friction does not occur between the guide and the combed sliver. The inner element is adjustably mounted by an eccentrically disposed screw to permit lateral adjustments relative to the table.

21 Claims, 1 Drawing Sheet

SLIVER GUIDE FOR A TEXTILE MACHINE

Figure 1:
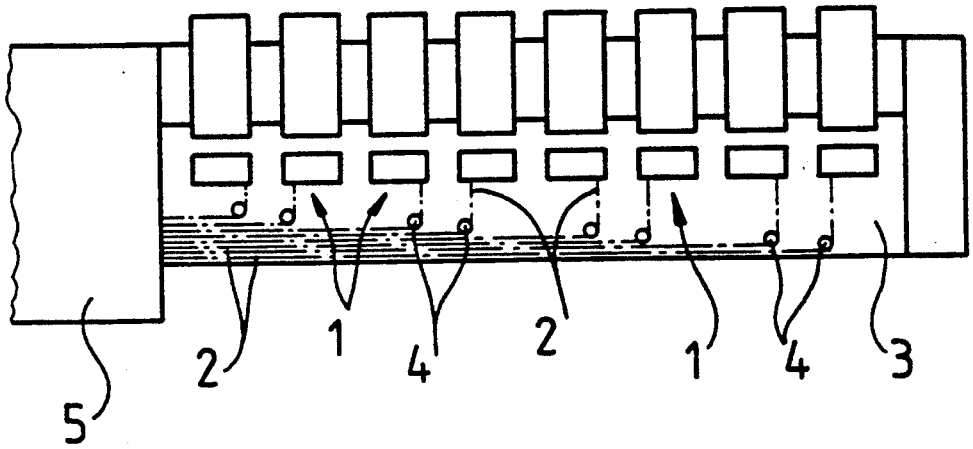

This invention relates to a sliver guide for a textile machine. More particularly, this invention relates to a sliver guide for a guide table of a combing machine.

As is known, conventional combing machines have a row of combing heads from each of which a combed sliver emerges onto a common delivery table. In addition, the combed slivers are individually taken around a sliver guide on the delivery table and then passed jointly to a drawframe. Currently, conventional sliver guides are simple, for example, cylindrical studs, which are usually fixed in an adjustable manner on the delivery table, for example, by means of an eccentric screw parallel to the axis of the stud. However, one disadvantage of the known sliver guide is that individual fibers of the combed slivers may jam and catch in a corner between a peripheral surface of the stud and the surface of the delivery table. Further fibers may then become deposited so that a tuft forms which is finally entrained by the moving combed sliver. This, in turn, may result in a malfunction, for example, stoppage of the drawframe and the entire machine. Another disadvantage is that the combed sliver ultimately deposits dirt and the like on the sliver guide, for example, honeydew, resin, husk parts, dressing and the like. Unless such impurities are removed at short intervals of time, the impurities increase the frictional force on the sliver passing about the guide with the result that the sliver can become torn. In addition, there is a possible impairment in the quality, that is, uniformity, of the sliver.

Accordingly, it is an object of the invention to preclude jamming and catching of a sliver about a sliver guide in a textile machine.

It is another object of the invention to avoid the depositing of dirt on a sliver guide during movement of a sliver thereover.

It is another object of the invention to avoid impairment of a sliver guided over a feed table of a textile machine.

Briefly, the invention provides a sliver guide for a textile machine in which the guide is comprised of an inner member and a sleeve rotatably mounted on and about the inner element on a common axis. In addition, the sleeve has a radially outwardly projecting flange at one end to support a sliver thereon.

The sliver guide is particularly useful in a textile machine having a table over which a plurality of slivers are directed, for example, from a plurality of combing machines to a drawframe. In this case, each guide has an inner element fixably mounted on the table while the sleeve is rotatably mounted for rotation about an axis perpendicular to the table in order to receive and deflect a sliver passing thereover from one direction to another direction. The outwardly projecting flange of each sleeve is also disposed adjacent a surface of the table.

The sliver guide permits the combed sliver to run around the sleeve while being supported by the flange on the sleeve so that individual sliver fibers cannot jam between the sliver guide and the delivery table surface. In this respect, the moving combed sliver is to entrain and rotate the sleeve so that no sliding friction occurs between the sliver and the sleeve. This substantially eliminates a risk of the combed sliver depositing dirt and the like on the sleeve. Also, the sleeve can, without difficulty, be made of plastics since there is no risk of static charging of the combed sliver. Likewise, the inner element of the guide may be made of plastics.

Should any individual fibers catch on the sleeve, these slivers can readily detach from the rotating sleeve before any tuft forms.

Figure 2:
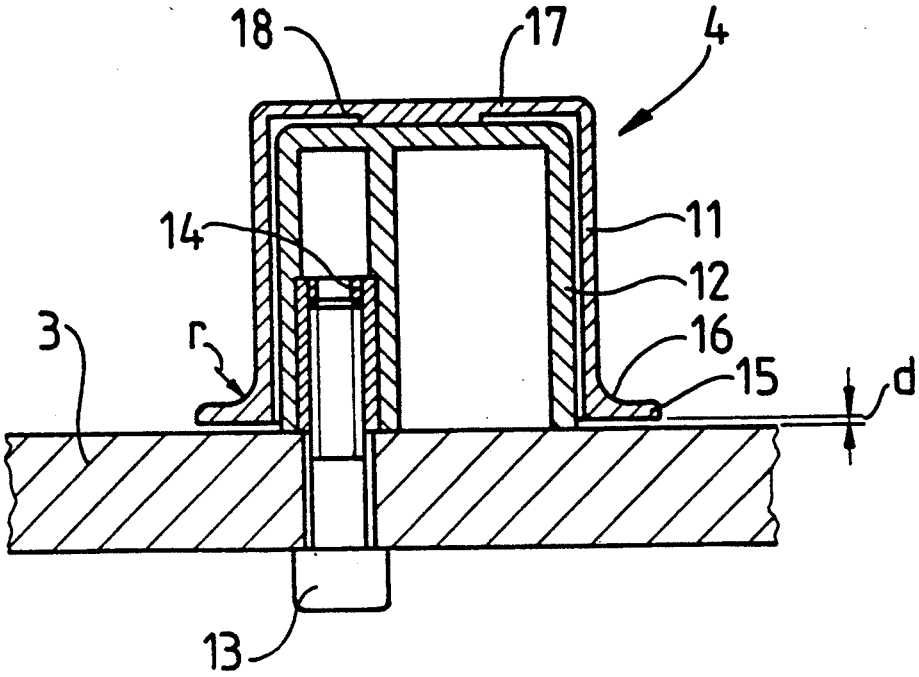

These and other objects and advantages of the invention will become more apparent from the following description taken in conjunction with the accompanying drawings wherein:

FIG. 1 illustrates a diagramatic plan view of a combing machine employing sliver guides in accordance with the invention; and FIG. 2 illustrates a vertical sectional view of a sliver guide constructed in accordance with the invention.

Referring to FIG. 1, the textile machine is in the form of a combing machine having a row of combing heads 1 each of which delivers a combed sliver 2 onto a common delivery table 3. The table 3 is provided with a plurality of sliver guides 4 each of which is associated with a respective head 1 to receive and deflect the associated combed sliver 2 from one direction into a longitudinal direction of the delivery table 3. As indicated, the deflected, combed slivers 2 run jointly to a drawframe 5 accommodated in a suitable housing.

Referring to FIG. 2, each sliver guide 4 is comprised of a preferably plastic sleeve 11 having a cylindrical peripheral wall as well as an inner element 12 about which the sleeve 11 is rotatably mounted on a common axis. The inner element 12 is in the form of a cylindrical hollow stud which may be made of plastic. As indicated, the inner element 12 is fixed on the delivery table 3 by means of a screw 13 which is threaded into a tapped bore or sleeve 14 in the inner element 12. This tapped bore or tapped sleeve 14 extends parallel to and eccentric to the central axis of the inner element 12 for receiving a fixing screw 13 in order to secure the inner element 12 to the table 3. Thus, before the screw 13 is tightened, the inner element 12 together with the sleeve 11 can be laterally displaced relative to table 3, for example, by pivoting around the axis of the screw 13 in order to adjust the length of travel or the distance between the sliver guide 4 and the edge of the table 3 for purposes of reliable sliver transport.

The sleeve 11 is formed with a radially outwardly projecting flange 15 at the lower end, as viewed, of the peripheral wall adjacent to the surface of the table 3 in order to support a sliver 2 thereof. In addition, the flange 15 has a width which is substantially identical to the diameter of the combed sliver, that is, the outside diameter of the flange 15 may be of from 15 to 30 millimeters larger than the outside diameter of the sleeve 11. The outer surface of the peripheral wall of the sleeve merges via a curvature 16 into the flange 15 on a radius r (in axial section) of about 2 to 8 millimeters. This provides a non-damaging deflection of the combed sliver and a good rotory drive of the sleeve 11 by the moving combed sliver.

The sleeve 11 should be rotatable as easily as possible on the inner element. To this end, the bottom surface of the flange 15 is spaced by a small amount d of about one millimeter from the surface of the delivery table 3. The sleeve 11 also bears on the top end face of the inner element 12 by means of a partition 17 which extends across the inner element 12 As indicated, this partition 12 closes off the sleeve 11 so as to prevent any penetration of dust or fiber fly from above between the wall of the sleeve 11 and the inner element 12 The bottom surface of the partition 17 has a projection 18 in the middle zone so as to bear on the top end face of the inner element 12 only in a middle zone. Of course, the same effect could be obtained with a flat bottom surface of the partition 17 and a projection on the middle zone of the top end face of the inner element 12.

The outside of the peripheral wall of the inner element 12 is spaced from the inside of the wall of the sleeve 11 by a small radial clearance of, for example, up to one millimeter and preferably 0.2 to 0.5 millimeters.

If desired, the sleeve 11 may be mounted by means of a ball bearing (not shown) on the inner element 12 As a rule, however, the plain bearing described provides adequate ease of rotation of the sleeve 11.

Alternatively, for the adjustable mounting of the inner element 12 on the delivery table 3, the tapped bore 14 maybe replaced by an eccentric bolt extending through a bore in the delivery table 3. Other possibilities may also be used for adjustable fixing of the inner element The sliver guides are particularly useful for guiding combed sliver from combing heads to a drawframe. Also, the sliver guides may be used on other textile machines where a sliver must be guided, for example, by a feed table of a drawframe.

The invention thus provides a sliver guide of relatively simple construction which avoids the depositing of dirt or the like on the guide and which also avoids static charging by a combed sliver passing thereover. Further, the provision of a flange on the rotatable sleeve prevents individual fibers of the combed sliver from jamming between the periphery of the guide and the surface of the delivery table.

What is claimed is:

1. A textile machine comprising a table; and a plurality of sliver guides for guiding at least one sliver over said table, each said guide including an inner element fixedly mounted on said table and a sleeve rotatably mounted on said inner element for rotation about an axis perpendicular to said table to receive and deflect a sliver passing thereover from one direction into a second direction, said sleeve having a radially outwardly projecting flange adjacent a surface of said table to support a sliver thereon.

2. A textile machine as set forth in claim 1 further comprising at least one combing head for delivering a combed sliver onto said table and a drawframe downstream of said table for receiving the combed sliver from said table.

3. A textile machine as set forth in claim 1 wherein said flange has an outside diameter of from 15 to 30 millimeters larger than an outside diameter of said sleeve.

4. A textile machine as set forth in claim 1 wherein said sleeve has a cylindrical peripheral wall merging into said flange on a radius of from 2 to 8 millimeters.

5. A textile machine as set forth in claim 1 wherein said flange is vertically spaced from said table surface a distance of up to 1 millimeter.

6. A textile machine as set forth in claim 1 wherein said sleeve has a partition extending across and supported on said inner element.

7. A textile machine as set forth in claim 1 which further comprises a projection on at least one of said inner element and said partition for supporting said sleeve on said inner element.

8. A textile machine as set forth in claim 1 wherein said sleeve is made of plastic.

9. A textile machine as set forth in claim 1 wherein said inner element is adjustably mounted on said table for lateral displacement relative to said table.

10. A textile machine as set forth in claim 1 wherein said inner element includes a tapped bore parallel to and eccectric to a central axis thereof for receiving a fixing screw to secure said inner element to said table.

11. A textile machine comprising a delivery table having a horizontally disposed surface;

a plurality of combing machines for delivering combed slivers onto said table;

a drawframe to receive the combed slivers from said table; and a plurality of sliver guides mounted on said table to deflect the slivers from said combing machines jointly towards said drawframe, each said guide including a rotatably mounted sleeve for rotation about an axis perpendicular to said table to receive and deflect a sliver passing thereover towards said drawframe.

12. A textile machine as set forth in claim 11 wherein said sleeve has a radially outwardly projecting flange adjacent a surface of said table to support a sliver thereon.

13. A textile machine as set forth in claim 13 wherein said flange has an outside diameter of from 15 to 30 millimeters larger than an outside diameter of said sleeve.

14. A textile machine as set forth in claim 13 wherein said sleeve has a cylindrical peripheral wall merging into said flange on a radius of from 2 to 8 millimeters.

15. A textile machine as set forth in claim 13 wherein said flange is vertically spaced from said table surface a distance of up to 1 millimeter.

16. A textile machine as set forth in claim 11 wherein each guide includes an inner element adjustably mounted on said table for lateral displacement relative to said table, said inner element having said sleeve rotatably mounted thereon about a common axis.

17. A sliver guide for a textile machine comprising an inner member having a tapped bore parallel to and eccentric to a central axis thereof for receiving a fixing screw; and a sleeve rotatably mounted on and about said inner element on said central axis, said sleeve having a radially outwardly projecting flange at one end to support a sliver thereon.

18. A sliver guide as set forth in claim 17 wherein said flange has an outside diameter of from 15 to 30 millimeters larger than an outside diameter of said sleeve.

19. A sliver guide as set forth in claim 18 wherein said sleeve has a cylindrical peripheral wall merging into said flange on a radius of from 2 to 8 millimeters.

20. A sliver guide as set forth in claim 18 wherein said sleeve has a partition extending across and supported on said inner element.

21. A sliver guide as set forth in claim 20 wherein said sleeve is made of plastic.

* * * * *

UNITED STATES PATENT AND TRADEMARK OFFICE

CERTIFICATE OF CORRECTION

PATENT NO. : 5,023,977

DATED : June 18, 1991

INVENTOR(S) : HELFRIED LANG

It is certified that error appears in the above-identified patent and that said Letters Patent is hereby corrected as shown below:

Column 4, line 30 change "13" to -12.

Title Page [73] change "Riter" to -Rieter-.

Signed and Sealed this

Second Day of March, 1993

*Attest:*

STEPHEN G. KUNIN

*Attesting Officer*

*Acting Commissioner of Patents and Trademarks*